United States Patent [19]

Egerer

[11] 4,005,513

[45] Feb. 1, 1977

[54] PINROLL WITH PINSTRIPS

[75] Inventor: Josef Egerer, Schwabach, Germany

[73] Assignee: Firma Staedtler & Uhl, Schwabach, Germany

[22] Filed: May 17, 1976

[21] Appl. No.: 687,415

[30] Foreign Application Priority Data

Mar. 27, 1976 Germany ..... 2613210

[52] U.S. Cl. ..... 29/121.5; 19/97; 19/234

[51] Int. Cl.[2] ..... B21B 1/40; D01G 19/04

[58] Field of Search ..... 19/97, 234, 233; 29/117, 121.5, 121.1

[56] References Cited

UNITED STATES PATENTS

| | | | |
|---|---|---|---|
| 1,610,407 | 12/1926 | Wood | 19/234 |
| 3,665,558 | 5/1972 | Egerer | 19/234 |

FOREIGN PATENTS OR APPLICATIONS

| | | | |
|---|---|---|---|
| 311,163 | 5/1929 | United Kingdom | 19/97 |

*Primary Examiner*—Dorsey Newton
*Attorney, Agent, or Firm*—Frank J. Jordan

[57] ABSTRACT

A pin roll includes a roll body having wedge grooves therein disposed parallel to the axis of the roll body. Pinstrips are disposed in the wedge grooves, and clamping wedges are disposed in the wedge grooves to hold the pinstrips therein. At least two parallel pegs in the roll body are disposed generally transversely of the wedge grooves. The clamping wedges have means defining oblique slots extending from the bottom thereof with the pegs being disposed in the oblique grooves. Operable means operable in a longitudinal direction and engageable with the wedge means are operable to effect securing and releasing of the pinstrips.

12 Claims, 11 Drawing Figures

PINROLL WITH PINSTRIPS

BACKGROUND OF THE INVENTION

The present invention relates to a pin roll with wedge grooves in the roll body, such wedge grooves being disposed parallel to the axis and serving to accept pinstrips each of which carry a plurality of pins at equally spaced distances. The pinstrips are held fast by clamping wedges acting in the direction of the bottom of the wedge grooves. Pin rolls of this kind are preferably used for drawing mechanisms and combers, but also as stretch pin rolls, perforating rolls, fibrilling rolls, and also as cutting rolls for films.

Pin rolls are already known (for example German DT-OS No. 2 002 020) which hold fast two pinstrips with wedge shaped clamping wedges onto a roll body or a segment of a roll body such pinstrips being each disposed on each side of the clamping wedge. The clamping wedges are fastened to the parent body with screws running approximately parallel to the axis of the wedge so that the wedges press both pinstrips onto the sides of the wedge groove. However, such fastening of the pinstrips cannot be used when the circumference of the roll is occupied by such a large number of pinstrips that the clamping wedges become too narrow to accept any more screw taps.

Other pin rolls are known which have boreholes at definite distances in the direction of the circumference and in the direction created thereby, such boreholes serving as depositories for single pins, such pins being held by pressure onto the end of the shaft. These boreholes may be arranged in such a manner that pins which each follow each other in the direction of the circumference are always disposed in radial planes. This version is extremely expensive, considering the plurality of boreholes in order to obtain the desired density of pins, and on the other hand the limited life of the parent body. Used or damaged pins must be knocked out of the parent body and be replaced by new ones. This process causes an enlargement of the boreholes each time, so that the whole roll becomes unserviceable after some time.

An object of the present invention is to provide an economical solution to this problem and to provide a pin roll which may be provided with clamping wedges for pinstrips even when the strips follow each other very closely and which also may be provided with the pins in radial planes.

According to the present invention of the above described character, each groove is traversed by at least two parallel pegs, and the clamping wedges have oblique slots, disposed in the same direction, which extend from their foot and are traversed by each of the pegs, and the clamping wedges are supported in the longitudinal direction of the wedge grooves in such a manner that they may be held and released by operable means disposed laterally relative to the body of the roll.

Due to the arrangement of the present invention, screws which traverse the clamping wedges become superfluous because action of the wedges is obtained when the clamping wedges are tightened by the cooperation of the pegs, which traverse the wedge grooves, with the respective oblique slots in the clamping wedges, when the clamping wedges are longitudinally displaced. The motions of arresting and of release occur in opposite directions.

In a further embodiment of the invention, a plurality of stop screws are disposed on one side of the roll body, each of these screws engaging the frontal side or longitudinal end of the clamping wedge. These stop screws may be anchored to the roll body in such a way that, depending on the direction in which the screws are turned, the clamping wedges move into the groove or out of the groove. Increasing pressure is exerted upon the pinstrips which abut when the clamping wedges are tightened and when the clamping wedges are lifted, the pressure is released and the pinstrips may be taken out.

It is particularly advantageous when the clamping wedges abut on their opposite frontside onto an adjustable counter element of the rollbody. Each counter element may, in a further embodiment of the present invention, be a setscrew. In this arrangement the stop screws may be used for the tightening of the wedge shaped clamping wedges and in contradistinction, the adjustable counter element may be used in order to lift out the pinstrip, in other words it is actuated against a setscrew.

The pegs, cooperating with the oblique slots of the pinstrips, traverse generally the wedge groove approximately perpendicularly in relation to the centerplane of the wedge groove, such plane passing through the imaginary or real point of the wedge. These pegs may be provided partly with a thread and may be screwed into the body of the body roll.

According to the present invention the body roll is provided with a contact surface for one front side of the pinstrip, and the end of the pinstrip which abuts this contact surface is disposed at a predetermined distance from the center axis of the neighboring outermost pin. Thus, the pinstrip is not arbitrarily cut off, but it ends at an exactly determined distance in relation to the outermost pin of the pin row. Thus every single pin on the circumference of the roll body is not arbitrarily, but exactly positioned. This arrangement, according to the present invention, makes it particularly possible to dispose the pins in individual radial planes, such pins following each other in the direction of the circumference of the pin roll.

It is particularly advantageous to dispose the contact surface abutting onto the roll body in a radial plane of the roll body. The position of each pin is practically unambiguously defined in relation to the roll body when the pinstrips abut onto this contact surface.

It is an object of the present invention to provide that both ends of the pinstrips are also always disposed at a predetermined distance in relation to the center axis of the neighboring outermost pin. These respective distances may be equal as well as different. This construction results in well defined designs of the pin arrangements upon the roll body.

If, for example, the mutual distances between the end of the pinstrip and the middle axis of the neighboring outermost pin amounts to half a pin distance or an odd multiple thereof, the pins of the pinstrips which follow in the direction of the circumferential direction overlap the distance between two pins of the preceding pinstrip, when pinstrips having such differing end distances are arranged alternatingly. Then the pins of alternating pinstrips are staggered. The arrangement of pins in single radial planes makes it also very simple to present two axially parallel disposed rolls to cooperate in such a way that the pins of one roll mesh in their action with the pins of the other roll.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A pin roll comprises a roll body, wedge grooves in the roll body disposed parallel to the axis of the roll body, pinstrips disposed in the wedge grooves, and clamping wedges disposed in the wedge grooves for holding the pinstrips therein. At least two parallel pegs in the roll body are disposed generally transversely of the wedge grooves. The clamping wedges have means defining oblique slots extending from the bottom thereof, with the pegs being disposed in the oblique grooves. Operable means operable in a longitudinal direction and engageable with the wedge means are operable to effect securing and releasing of the pinstrips.

DESCRIPTION OF THE PREFERRED EMBODIMENTS

Figure 7:
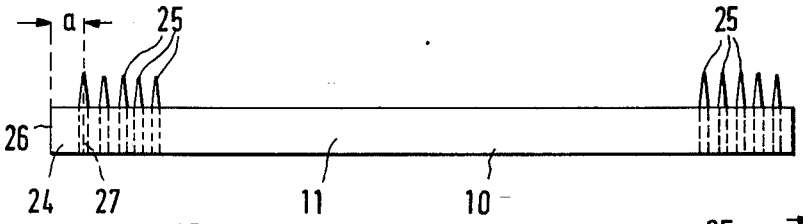
FIG. 7 is a side elevation view of a pinstrip.
Figure 8:
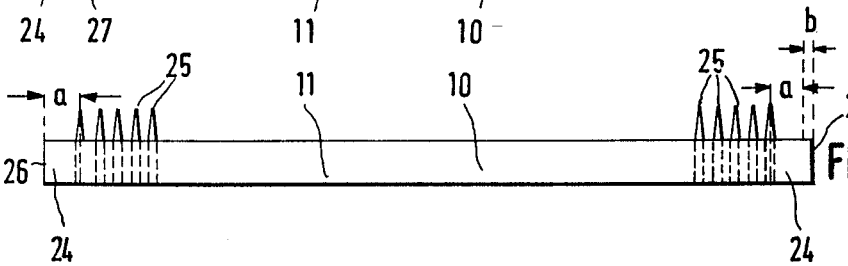
FIG. 8 is a side elevational view of another embodiment of a pinstrip.

Referring to the drawings, generally a pin roll comprises a cylinder or roll body 2 having a center borehole 1. The roll body 2 is provided with a plurality of wedge grooves 3 extending from the circumference thereof and disposed generally parallel to the axis of the cylinder 2. The grooves 3 widen radially outwardly, are generally wedge-shaped, and extend between both frontal partitions or end parts 4 and 5 of the roll body 2. The longitudinal center axis 6 of each wedge groove 3 forms with a radial line 7 passing through the bottom 8 of the groove 3 an angle of about 40°. A step-shaped setoff 9 is provided on each of the walls of the wedge groove 3, such setoff serving as a rest for the foot 10 of a pinstrip 11 (FIGS. 7 and 8). Each wedge-shaped groove 3 is traversed by two parallel pegs 12, such pegs 12 being disposed approximately at right angles relative to the longitudinal centerline 6 of the wedge groove 3. The pegs 12 are threaded into the roll body 2 at the threads 13.

Each wedge-shaped groove 3 serves to accept a clamping wedge 14 which is provided with oblique slots 16, such slots 16 extending from the foot 15 of the wedge 14. The slots 16 appropriate in their width the diameter of the pegs 12 and are of the same number. These slots 16 extend obliquely at an angle of about 40° relative to the foot 15 of the clamping wedge 14 as can best be seen in FIG. 2. The outer plane 17 of the wedge 14 is chamfered in such a way that it rests approximately at the upper end of the opening of the wedge groove 3 when the clamping wedge 14 is inserted into the wedge groove 3. A pinstrip 11 is inserted into each of the stepped off interspaces 18 on both sides of the clamping wedge 14. When the wedge shaped clamping wedge 14 is tightened, the pinstrips 11 are tightly pressed in the interspaces 18.

Figure 1:
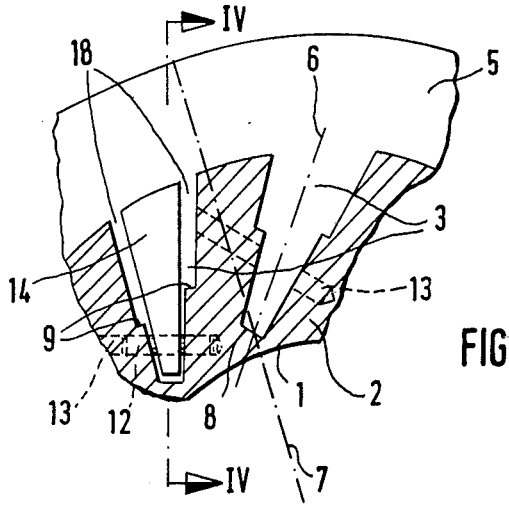
FIG. 1 is a partial schematic view of a roll body taken along the line I—I in FIG. 4.
Figure 2:
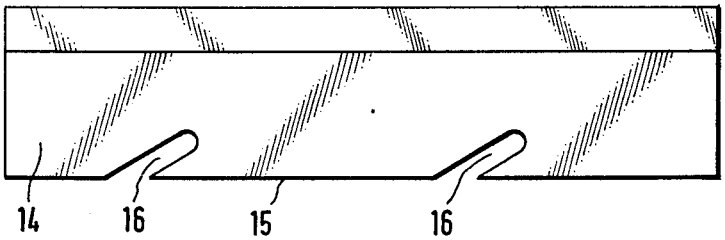
FIG. 2 is a side view of the clamping wedge.
Figure 3:
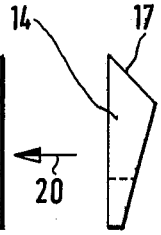
FIG. 3 is a front view of the clamping wedge.
Figure 4:
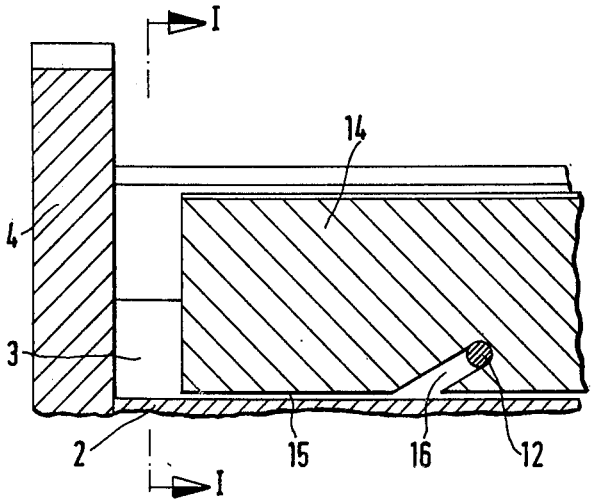
FIG. 4 is a partial longitudinal sectional view taken through the roll body approximately along the line IV—IV in FIG. 1.
Figure 5:
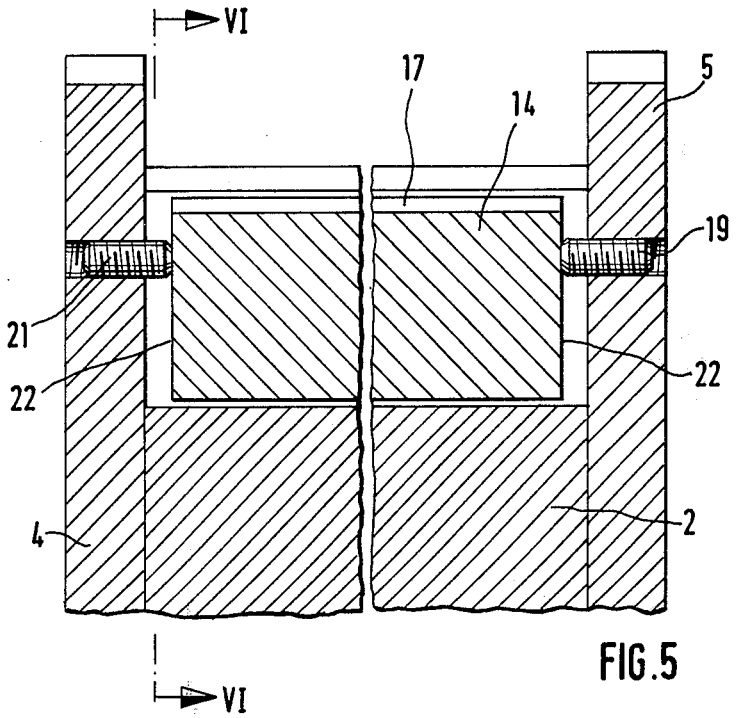
FIG. 5 is a longitudinal sectional view taken through the roll body showing two fastening means for the clamping wedges.
Figure 6:
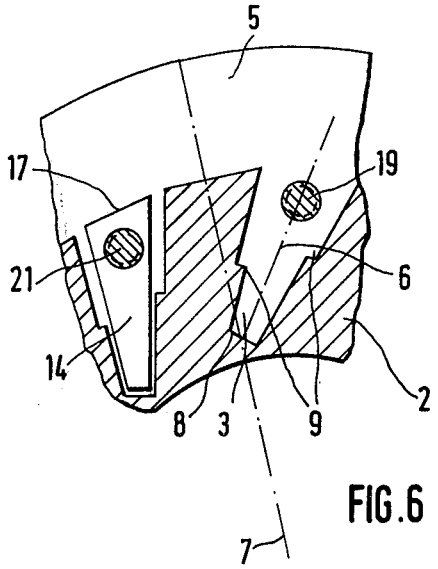
FIG. 6 is a view taken along line VI—VI in FIG. 5.

An arresting screw 19 holds fast the clamping wedge 14 with the arresting screw 19 acting upon the clamping wedge 14 in the direction of the arrow 20 (see FIG. 2). The engagement of the oblique slots 16 and the transversed pegs 12 pulls the clamping wedge 14 into the wedge groove 3. In the embodiment of FIG. 5 tap bolts 21 are screwed into the oppositely disposed frontal wall 4 of the roll body 2, their number corresponding to the number of clamping wedges 14, each of the tap bolts 21 acting upon the frontal side 22 of the corresponding clamping wedge 14. In order to release the clamping wedge 14, at first the screw 19 is loosened and then the screw 21 is tightened so that the clamping wedge 14 is shifted longitudinally and thereby lifted out of the wedge groove 3 due to the engagement provided by the transverse pegs 12. This releases the pinstrips 11 from the clamping action in the interspaces 18, and the pinstrips may then be lifted out.

Figure 9:
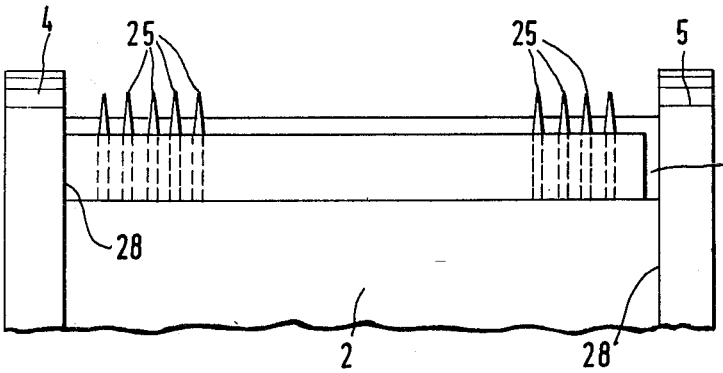
FIG. 9 is a view of the roll body with the pinstrip disposed thereon.

The pinstrips 11 according to FIGS. 7 to 9 are of well known construction. In FIG. 7 the pinstrip 11 is provided at its end with a free projection 24 which is not provided with pins 25. The distance between the end 26 of this pinstrip 11 and the center axis of the neighboring outermost pin 27 is of a predetermined length *a*. If the consecutive pinstrips 11 abut with their ends 26 onto a contact surface 28 of a radial plane of the frontal wall 4 and 5 respectively of the roll body 2, and if the contact surface 28 is disposed in a radial plane of the roll body 22, and if, on the other hand, the abutting ends of the pinstrips are all disposed at the predetermined distance *a*, then the pin roll will have parallel rows of pins which again are disposed in single radial planes. A prerequisite is though, that all pins 25 are in a known manner disposed upon the pinstrip 11 at equal distances. That is self evident in the case of the pinstrips 11. In the embodiment according to FIG. 9 the pinstrips rest against the contact surface 28 of the frontal wall 4 of the roll body 2.

Figure 11:
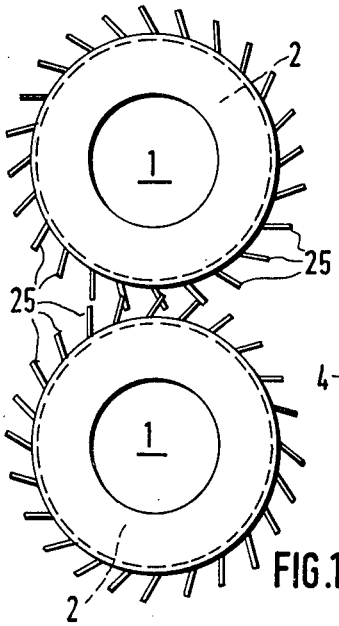
FIGS. 10 and 11 are schematic views showing the arrangement of the pins upon the roll body in side elevation and front elevation respectively.
Figure 10:
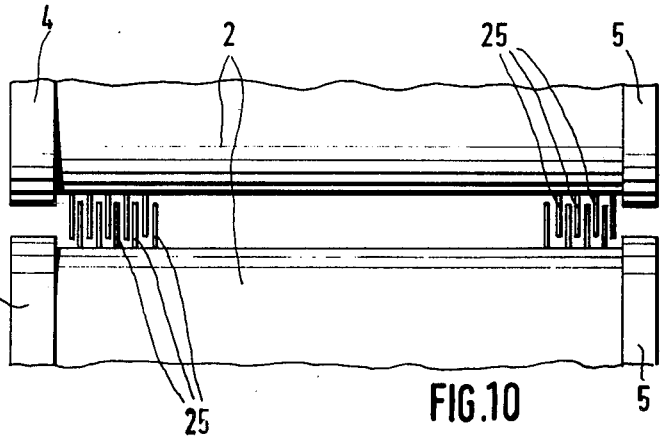

FIG. 8 shows an arrangement of a pinstrip 11 where respective projections 24 exist on both sides of the pinstrip. However, they differ in length. While at the left end of the pinstrip 11 the distance between the end 26 and the center axis of the neighboring outermost pin 27 amounts again to *a*, the distance at the right end is, for example, *a* plus *b*, where *b* corresponds to one-half of the distance between the longitudinal center axes of two neighboring pins 25. It could also amount to an odd multiple of this half distance. In this embodiment consecutive pinstrips may alternatingly rest with the end 26 or with the oppositely disposed end 29 against a contact surface 28 of the roll body 2. Then the image of a pin arrangement which is shown in FIG. 10 demonstrates that the pins 25 of one roll act in the spaces between the pins 25 of the other roll. This arrangement is also clearly shown in FIG. 11 where the pins 25 of both pin rolls mesh.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A pin roll comprising a roll body, wedge grooves in said roll body disposed parallel to the axis of said roll body, pinstrips disposed in said wedge grooves, clamping wedges disposed in said wedge grooves and holding said pinstrips in said wedge grooves, at least two parallel pegs in said roll body disposed generally transversely of said wedge grooves, said clamping wedges having means defining oblique slots extending from the bottom thereof, said pegs being disposed in said oblique grooves, and operable means operable in a longitudinal direction and engageable with said wedges means to effect securing and releasing of said pinstrips.

2. A pin roll according to claim 1 wherein said operable means comprises a plurality of threaded members threaded to said roll body and having their axes disposed parallel to the axis of said roll body, each of said threaded members being engageable with the longitudinal ends of said clamping wedges.

3. A pin roll according to claim 2 wherein said threaded members are disposed on said roll body to engage opposite longitudinal ends of said clamping wedges.

4. A pin roll according to claim 2 wherein said threaded members are set screws.

5. A pin roll according to claim 1 wherein said oblique slots extend at an acute angle relative to the longitudinal axis of said clamping wedges such that longitudinal displacement of said clamping wedges will effect radial displacement of said clamping wedges due to the engagement between said pegs and said oblique slots.

6. A pin roll according to claim 1 wherein the axis of said wedge grooves are disposed at an acute angle relative to a radial line on said roll body, said pegs having their longitudinal axes disposed generally transversely of said axes to said wedge grooves, said pegs being threadedly secured to said roll body.

7. A pin roll according to claim 1 wherein said roll body has transverse contact surfaces at the longitudinal ends of said pinstrips, said pinstrips having a plurality of equally spaced pins with the pins at the longitudinal end of said pinstrip being spaced a predetermined distance from said contact surface of said roll body.

8. A pin roll according to claim 7 wherein said transverse contact surfaces are disposed on a transverse radial plane of said roll body.

9. A pin roll according to claim 1 wherein the pins at both longitudinal ends of said pinstrips are spaced a predetermined distance from the respective longitudinal end of said pinstrip.

10. A pin roll according to claim 1 wherein the pins at one longitudinal end of said pinstrip are spaced at a distance from the respective longitudinal end of the pinstrip which differs from the distance that the pins at the other longitudinal end of the pinstrip are spaced from the respective longitudinal end of the pinstrip.

11. A pin roll according to claim 10 wherein the pins at one longitudinal end of said pinstrip are spaced at a distance from the respective longitudinal end of the pinstrip an amount which is one-half the distance that the pins on the other longitudinal end of the pinstrip are spaced from the respective longitudinal end of the pinstrip.

12. A pin roll according to claim 10 wherein the pins at one longitudinal end of said pinstrip are spaced at a distance from the respective longitudinal end of the pinstrip an amount which is a multiple of the distance that the pins on the other longitudinal end of the pinstrip are spaced from the respective longitudinal end of the pinstrip.

* * * * *